US006604531B2

(12) United States Patent
Nakamura et al.

(10) Patent No.: US 6,604,531 B2
(45) Date of Patent: Aug. 12, 2003

(54) ANTIMICROBIAL AND DEODORANT COSMETIC BRUSH AND METHOD

(76) Inventors: Kenji Nakamura, c/o Taiki Awaji Factory, 3-41 Nishiawaji 6-chome, Higashi Yodogawa-ku, Osaka-shi, Osaka (JP); Koji Nakamura, c/o Taiki Awaji Factory, 3-41 Nishiawaji 6-chome, Higashi Yodogawa-ku, Osaka-shi, Osaka (JP)

( * ) Notice: Subject to any disclaimer, the term of this patent is extended or adjusted under 35 U.S.C. 154(b) by 0 days.

(21) Appl. No.: 10/068,085

(22) Filed: Feb. 5, 2002

(65) Prior Publication Data

US 2002/0144703 A1 Oct. 10, 2002

(30) Foreign Application Priority Data

Feb. 6, 2001 (JP) ..... 2001-029734

(51) Int. Cl.[7] ..... A46B 15/00

(52) U.S. Cl. ..... 132/200; 132/313; 15/207.2; 428/375; 8/127.6

(58) Field of Search ..... 132/200, 313, 132/120, 163; 15/207.2; 428/375, 378, 393, 395; 8/127.5, 127.51, 127.6, 99.14, 606, 188

(56) References Cited

U.S. PATENT DOCUMENTS 5,186,929 A * 2/1993 DeMarco et al. ..... 424/71
5,261,426 A * 11/1993 Kellett et al. ..... 132/108
5,723,132 A * 3/1998 Tseng et al. ..... 424/401
5,765,573 A * 6/1998 Gueret ..... 132/218
5,994,383 A * 11/1999 Dyer et al. ..... 514/390
6,428,799 B1 * 8/2002 Cen et al. ..... 424/402

FOREIGN PATENT DOCUMENTS

| | | |
|---|---|---|
| JP | 48-27389 | 8/1973 |
| JP | U 48-31719 | 9/1973 |
| JP | U 50-40688 | 11/1975 |
| JP | 53-128451 | 11/1978 |
| JP | 02-274205 | 11/1990 |
| JP | 03-289905 | 12/1991 |
| JP | 05-7510 | 1/1993 |
| JP | U 3019605 | 10/1995 |
| JP | U 3063570 | 8/1999 |

* cited by examiner

*Primary Examiner*—Eduardo C. Robert
*Assistant Examiner*—David Comstock
(74) *Attorney, Agent, or Firm*—Knobbe, Martens, Olson & Bear LLP

(57) ABSTRACT

Natural bristles (animal hairs) are submerged in a solution containing at least one or more kinds of cationic surfactants selected from alkyl ammonium salts containing a quaternary nitrogen or alkylbenzyl ammonium salts containing a quaternary nitrogen, and alkylpyridinium salts to adsorb the cationic surfactants onto the natural bristles in an amount of 0.2–5% by weight by treating with heat, and a hair brush is produced using these natural bristles.

8 Claims, 2 Drawing Sheets

ANTIMICROBIAL AND DEODORANT COSMETIC BRUSH AND METHOD

BACKGROUND OF THE INVENTION

1. Field of the Invention

The present invention relates to cosmetic brushes composed of natural bristles (animal hair), which have excellent antimicrobial and deodorant properties and wash-durable antimicrobial properties, and to methods of producing the same.

Furthermore, the present invention relates to cosmetic brushes composed of natural bristles, which use cationic surfactants selected from alkyl ammonium salts or alkylbenzyl ammonium salts containing quaternary ammonium salts and alkyl pyridinium salts, exhibit excellent halo effect and have excellent antimicrobial and deodorant properties and wash-durable antimicrobial properties, and to methods for producing the same.

2. Description of the Related Art

Today, the demand for so-called antimicrobial articles in every field is high as a result of the reflection of hygiene-oriented tendency in society and at home.

Among household articles, consumer demand for antimicrobial properties in toothbrushes is particularly high because toothbrushes are used in the mouth and stored in a moist condition in which bacteria readily grow. Accordingly, a large number of techniques have conventionally been disclosed for antimicrobial toothbrushes. Typical examples are toothbrushes which are treated with surfactants or disinfectants having antimicrobial properties. Examples include an antimicrobial-durable toothbrush which is treated with a solvent solution of disinfectant such as trichlorocarbanilide containing a small amount of lipophilic nonionic surfactant (Japanese Patent Publication No. S48-27389) and a self-sterilizing toothbrush into which a disinfectant such as halogenated salicylanilide and trichlorocarbanilide is permeated (Japanese Utility Model No. S48-31719; Japanese Utility Model No. S50-40688).

Further, reflecting the hygiene-oriented and beauty-oriented tendency of consumers, the demand for antimicrobial properties is also naturally high in hairbrushes, cosmetic brushes and the like other than toothbrushes, in which dandruff, skin dirt or skin oil tends to remain adhered, and all sorts of airborne germs grow and generate molds and unpleasant odors, which create an unhygienic condition. However, surprisingly very few techniques regarding antimicrobial or sterile brushes of such kind have been disclosed. Among the few are a method of rendering antimicrobial properties to natural bristle brushes by adding styrene glycol to a solution of an antimicrobial agent such as isopropylmethyl phenol (Japanese Patent Application Laid-open No. S53-128451) and a method of enhancing antimicrobial properties by treating natural bristles with a phenol antimicrobial agent solution under pressure to permeate the antimicrobial agent into the inside of the bristles (Japanese Patent Application Laid-open No. H03-289905).

On the other hand, research into improving antimicrobial agents for brushes have progressed and antimicrobial agents having excellent antibacterial activity and durability have become usable. For example, a method in which natural bristles are cationized with a cationizing agent having two or more quaternary ammonium groups in a molecule and reacted with an amphoteric or anionic disinfectant (Japanese Patent Application Laid-open No. H02-274205), a method in which a benzimidazole compound and a pyridine compound are used in combination as an antimicrobial agent (Japanese Patent Application Laid-open No. H05-7510), and a method in which use of a quaternary ammonium salt as a disinfectant is suggested (Registered Japanese Utility Model No. 3019605: Heisei 7; Registered Japanese Utility Model No. 3063570: Heisei 11) have been disclosed.

However, in the prior art described above, antimicrobial efficacy by antimicrobial agents is excellent in the early stage of treatment but it is substantially insufficient. As a result, the brush body and natural bristles become blackish due to the growth of bacteria and molds and generation of unpleasant odor cannot be completely prevented. Furthermore, the antibacterial agents gradually fall out and the antimicrobial property is not durable and shortly disappears, which does not fully satisfy consumer need.

In general, in order to remove remaining cosmetic agents after each use, cosmetic brushes are always washed with water or hand-washed with rubbing after use. Therefore, high wash-durability is required. To satisfy this requirement, a binder was conventionally used to increase wash-durability, which caused a rough feel to the skin and was not accepted by consumers.

Among the abovementioned known techniques, the most frequently used method for the treatment of natural bristles is a method in which the natural bristles are submerged in a solution of commonly used antimicrobial agent, and after solvent removal, the bristles are dried to immobilize the antimicrobial agent or disinfectant. However, in this method, particularly in cosmetic brushes, the tip of the natural bristles hardened because of physical changes caused by the antimicrobial agent, resulting in disadvantages in use, such as roughness of the cosmetic brush to the skin and poor retention of cosmetic agents on the cosmetic brushes.

Further, conventionally, even when common quaternary ammonium salts were used, the antimicrobial agents did not sufficiently adhere onto natural bristles and unpleasant natural bristle odor could not be prevented, retention of antimicrobial properties after washing (i.e., wash-durability) was poor, and the halo width, i.e., an index for antimicrobial efficacy, was insufficient.

SUMMARY OF THE INVENTION

The present invention relates to brushes, particularly cosmetic brushes which are highly demanded reflecting the current fashion-oriented, aesthetic requirement. The present invention intends to solve the abovementioned problem and provide a cosmetic brush characterized in that it is markedly antimicrobial, the retention of the antimicrobial properties is long, it has no natural bristle odor, the use of insecticide is not necessary because it has insecticidal effect, and further hardening of the tip of the natural bristles due to physical changes caused by antimicrobial agents does not occur, which results in smoothness to the skin and excellent retention of cosmetic agents on the cosmetic brush.

Accordingly, by directing attention to the utilization of those quaternary ammonium salts used in prior art and more sufficiently adhering antimicrobial agents to natural bristles, an objective of the present invention is to provide a cosmetic brush in which natural bristle odor is prevented, the halo width is sufficient, wash-durability of antimicrobial properties is satisfactory, and further insecticidal effect renders a function as an insecticide.

The halo width used in the present invention is generally known as a standard or an index of antimicrobial properties in antimicrobial articles. In an antimicrobial test, gram-positive and gram-negative bacteria are cultured on an agar medium, an antimicrobial agent diffuses on the agar medium plate, and after cultivation, the area around a test strip of natural bristles, where bacterial growth was inhibited, is measured to numerically express the antimicrobial properties.

The halo width is generally measured in accordance with JIS-L-1902, and represented by the following equation:

$$W=(T-D)/2$$

W: halo width

T: total length of test strip and halo (mm)

D: length of test strip (mm)

In order to solve the abovementioned problem in cosmetic brushes, the present inventors have conducted intensive studies to complete the present invention by using particular quaternary ammonium salts selected from quaternary ammonium salts used as cationic surfactants for treating the cosmetic brushes.

Furthermore, the present inventors have found that among cationic surfactants, alkyl pyridinium salts have similar antimicrobial or disinfectant characteristics.

Namely, the present inventors directed their attention to the affinity of various surfactants having antimicrobial properties to natural bristle proteins. Various surfactants having excellent antimicrobial properties, mainly quaternary ammonium salts, were adsorbed or adhered onto natural bristles and their efficacy was compared. The present inventors, having focused on cationic surfactants which are adsorbed onto natural bristle proteins and are difficult to be removed by washing, found that antimicrobial properties of natural bristles is remarkably improved when alkyl ammonium salts or alkylbenzyl ammonium salts containing a quaternary nitrogen and further, alkyl pyridinium salts, were used, and thus completed the present invention.

The present invention can economically provide an inexpensive cosmetic brush composed of natural bristles which is markedly smooth to the skin, well holds cosmetic agents, has excellent antimicrobial properties, and has long-lasting wash-durable antimicrobial properties, by treating natural bristles in a warm bath containing ammonium salts virtually without changing the shape, appearance or feel of the natural bristles.

Further, the present inventors have succeeded in preventing bacterial odor generation, preventing animal hair odor characteristic to natural bristles, which has been considered to be most difficult, and further improving wash-durability of antimicrobial properties, by using the abovementioned quaternary ammonium salts or alkyl pyridinium salts to sufficiently adhere the antimicrobial agents onto the natural bristles.

In the present invention, a number of quaternary ammonium salts were applied to be adsorbed onto natural bristles and their efficacy was compared. The results revealed that when cationic surfactants, in particular alkyl ammonium salts or alkylbenzyl ammonium salts containing a quaternary nitrogen and alkyl, were used, their adsorption onto the natural bristle protein was high, the antimicrobial properties was hard to remove by washing and well retained and, the feel of the hair tip to the skin was markedly gentle, cosmetic agents were well held, and animal hair odor was prevented, virtually without changing the shape, appearance or feel of the natural bristles, and further, that insecticidal effect was generated so that there was no need to use conventionally used insecticides such as naphthalene.

Further, the present invention revealed that cationic surfactants, alkyl pyridinium salts, were also as effective as the abovementioned quaternary ammonium salts in the same manner as described above.

Furthermore, the present invention is characterized in unique contrivances, such as adsorption of antimicrobial agent in a heated solution and use of an auxiliary agent and a protein denaturation agent as described below.

DETAILED DESCRIPTION OF THE PREFERRED EMBODIMENT

Figure 1:
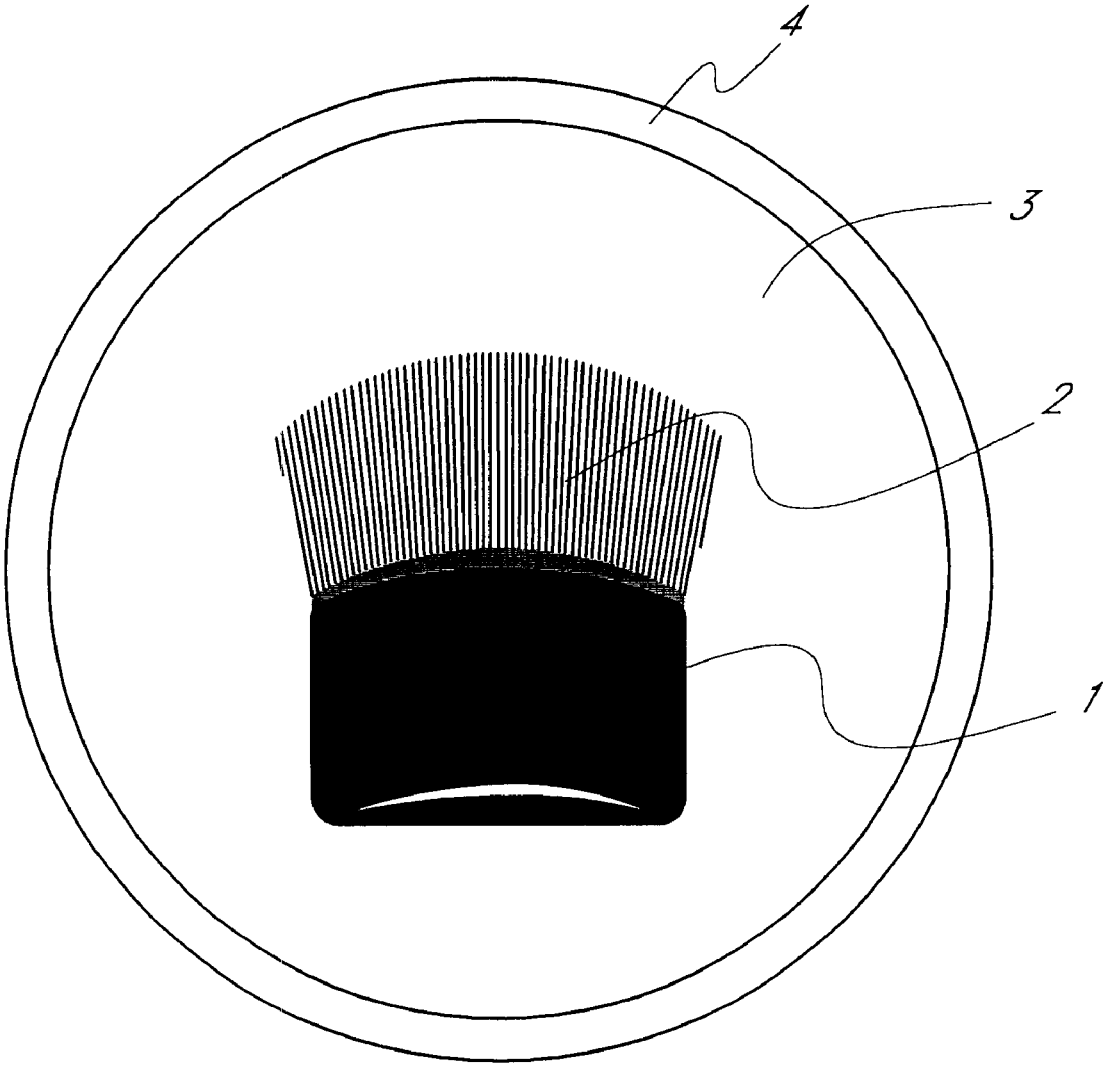
FIG. 1 is a view showing an untreated cosmetic brush.

The present invention is a method of obtaining a cosmetic brush using a particular quaternary ammonium salt as an antimicrobial agent; however, the invention also includes a method of producing a cosmetic brush by adsorbing a cationic surfactant selected from alkyl pyridinium salts using a specific method such as treatment with a heated solution.

Namely, the present invention fundamentally comprises the following (1) through (8), and additionally includes various modifications and applications thereof (1) A cosmetic brush having wash-and-rub-durable antimicrobial and deodorant properties, characterized in use of natural bristles (animal hair) to which at least one or more kinds of cationic surfactants selected from alkyl ammonium salts containing a quaternary nitrogen or alkylbenzyl ammonium salts containing a quaternary nitrogen, and alkylpyridinium salts in an amount of 0.2–5% by weight are adhered by heat solution adsorption.

(2) The cosmetic brush having wash-and-rub-durable antimicrobial and deodorant properties as described in (1) above, wherein proteins of the natural bristles are denatured by a protein denaturation agent.

(3) A method of producing a cosmetic brush having wash-and-rub-durable antimicrobial and deodorant properties, characterized in that natural bristles are submerged into an aqueous solution containing at least one or more kinds of cationic surfactants selected from alkyl ammonium salts containing a quaternary nitrogen or alkylbenzyl ammonium salts containing a quaternary nitrogen, and alkyl pyridinium salts, said cationic surfactants in an amount of 0.2–5% by weight are adhered onto the natural bristles by adsorption with heating, and then the resulting natural bristles are used for the cosmetic brush.

(4) The method of producing a cosmetic brush as described in (3) above, wherein an auxiliary agent for adsorption of the abovementioned cationic surfactants and/or a protein denaturation agent are added to the abovementioned aqueous solution.

(5) The method of producing a cosmetic brush as described in (3) above, wherein the protein denaturation agent is urea or guanidine hydrochloride.

(6) The method of producing a cosmetic brush as described in (3) above, wherein the auxiliary agent for adsorption is an inorganic acid, organic acid or inorganic salt.

(7) The method of producing a cosmetic brush as described in (6) above, wherein the organic acid is acetic acid, lactic acid, malic acid, or citric acid.

(8) The method of producing a cosmetic brush as described in (6) above, wherein the inorganic salt is sodium sulfate or sodium chloride.

A cosmetic brush of the present invention will be explained referring to the drawings.

A cosmetic brush of the present invention is mainly used to apply various cosmetic agents, such as foundations and face powders, on the face or skin of females. As shown in FIG. 1, natural bristles 2 are embedded to a brush body 1 as a brush head. In general, the brush body is made of plastic, wood or the like.

The natural bristles used in the present invention are not particularly limited and those commonly used for brushes, such as bristles from horses, pigs, goast, and raccoon dogs, can be used. These natural bristles are characterized by the better feel to the skin and better water retention and no static electricity generation as compared to synthetic products such as nylon bristles.

As described above, in the present invention, a cosmetic brush having wash-and-rub-durable antimicrobial and deodorant properties is produced by using natural bristles to which at least one or more kinds of specific cationic surfactants, in particular alkyl ammonium salts or alkylbenzyl ammonium salts containing a quaternary nitrogen, and further, alkyl pyridinium salts, in an amount of 0.2–5% by weight are adhered by adsorption with heating. The abovementioned alkyl ammonium salts or alkyl benzyl ammonium salts containing a quaternary nitrogen, and further, alkyl pyridinium salts, are conventionally and frequently used as a surfactant and have excellent antimicrobial properties as well as deodorant properties by itself.

For example, alkyl ammonium salts are alkyl trimethyl ammonium salts or dialkyl dimethyl ammonium salts, alkylbenzyl ammonium salts are alkyldimethylbenzyl ammonium salts, and alkyl pyridinium salts are salts in which an alkyl group bonds to a pyridine ring. They are salts in which a quaternary nitrogen forms a positive ion and a halogen atom such as chlorine and bromine forms a negative ion, and are represented as $(R_3\ N—R)^+X^-$.

However, the present invention is based on the fact that among the abovementioned cationic surfactants, in particular, the abovementioned alkyl ammonium salts or alkyl benzyl ammonium salts containing a quaternary nitrogen, and alkyl pyridinium salts exhibit an exceptional effect.

Namely, in the present invention, a number of surfactants having excellent antimicrobial properties, mainly quaternary ammonium salts, were applied for adsorption onto natural bristles and their effect was compared. The results showed that when the abovementioned cationic surfactants of the present invention were used, adsorption onto the natural bristle proteins was high and antimicrobial properties were difficult to remove by washing and well retained and, the feel of the hair tip to the skin was markedly gentle and cosmetic agents were well held, and animal hair odor was prevented, virtually without changing the shape, appearance or feel of the natural bristles.

In the natural bristles treated with these compounds, the abovementioned quaternary ammonium salts exude not just immediately after treatment but also exude gradually thereafter, so that the antimicrobial and deodorant properties of the cosmetic brushes can be retained for a long period of time.

Examples of quaternary ammonium salts to be used in the present invention include (1) as alkylammonium salts, alkyltrimethyl-type ammonium salts such as dodecyltrimethylammonium chloride, alkyltrimethylammonium chloride, hexadecyltrimethylammonium chloride, octadecyltrimethylammonium chloride, lauryltrimethylammonium chloride, lauryltrimethylammonium chloride, myristyltrimethylammonium chloride, stearyltrimethylammonium chloride, stearyltrimethylammonium bromide, oleyltrimethylammonium chloride, and oleyltrimethylammonium bromide; and dialkyldimethyl-type ammonium salts such as octylhexyldimethylammonium chloride, didecyldimethylammonium chloride, and dioctyldimethylammonium chloride; (2) alkylbenzylammonium salts such as myristyldimethylbenzylammonium chloride, yashialkyldimethylbenzylammonium chloride, tetradecyldimethylbenzylammonium chloride, octadecyldimethylbenzylammonium chloride, cetyldimethylbenzylammonium chloride, stearyldimethylbenzylammonium chloride, and oleyldimethylbenzylammonium chloride.

Further, alkylpyridinium salts such as laurylpyridinium chloride and cetylpyridinium chloride can be used.

In the present invention, at least one or more kinds of the abovementioned cationic surfactants, in particular alkyl ammonium salts or alkyl benzyl ammonium salts containing a quaternary nitrogen, and alkyl pyridinium salts are used appropriately in combination; however, fundamentally, the use of one kind is sufficient.

An appropriate amount to be used is in a range between 2% and 5% by weight. The antimicrobial and deodorant effects are not sufficient in an amount of less than 0.2% by weight, and the antimicrobial and deodorant effects are saturated and not economical in an amount of 5% or more by weight.

An appropriate means for adhering an antimicrobial agent of the present invention to natural bristles is adhesion by adsorption using a heated solution. An appropriate temperature of the heated solution ranges from about 60C to 80C, preferably 70C or higher. The natural bristles are treated for about 30 minutes, washed with water and dried, thereby making the hair tips comfortable to the skin and preventing animal hair odor virtually without changing the shape, appearance and feel of the natural bristles.

Further, it is economical to carry out this treatment after washing or dying the natural bristles.

The cosmetic brush of the present invention is wash-durable, that is, it maintains wash-durability for antimicrobial properties when the brush is washed with water or hand-washed with rubbing to remove cosmetic agents after each use.

The antimicrobial properties of the present invention is expressed by the halo width (width of inhibition of bacterial growth) as mentioned above. The halo width is commonly used as a standard or an index of antimicrobial efficacy of antimicrobial articles. In an antimicrobial test, gram-positive and gram-negative bacteria are cultured on an agar medium, an antimicrobial agent diffuses on the agar medium plate, and after cultivation, the area where bacterial growth was inhibited around a test strip of natural bristles is measured to numerically express the antimicrobial efficacy in accordance with the JIS standard as mentioned above.

The natural bristles treated with an antimicrobial agent according to the present invention showed a halo width of at least 2 mm in accordance with the abovementioned halo test (based on JIS-L-1902). The halo width of this natural bristles was reduced only a little even after washing 100 times with rubbing after submersing in a washing solution according to the JIS-L-1042 (a soap solution, 5 g/L) at 40° C. for 30 minutes.

Thus, it is confirmed that cationic surfactant antimicrobial agents which are absorbed to proteins, did not lose their activity by binding anionic surfactants.

Further in the present invention, natural bristles are submerged into an aqueous solution containing at least one or more kinds of cationic surfactants selected from alkyl ammonium salts or alkylbenzyl ammonium salts containing a quaternary nitrogen, and further, alkyl pyridinium salts, and the cationic surfactants in an amount of 0.2–5% by weight are adhered onto the natural bristles by adsorption with heating, and then the resulting natural bristles are used for a cosmetic brush. In manufacturing, the natural bristles are treated in an aqueous solution containing antimicrobial agents at a concentration of about 1–3% by weight at about 60° C. to 80° C., preferably 70° C. or higher, for about 30 minutes, washed with water and dried.

During this treatment, a protein denaturation agent and/or an auxiliary agent for adsorption are used to increase the effect of adsoption and fixing of the abovementioned cationic sufractants to the natural bristles.

Urea, guanidine hydrochloride, and the like are used as the abovementioned protein denaturation agent. Inorganic acids, organic acids or inorganic salts are used as the auxiliary agent for absorption. For example, inorganic acids to be used are hydrochloric acid, sulfuric acid, and phosphoric acid, organic acids to be used are acetic acid, lactic acid, malic acid, and citric acid, and inorganic salts are sodium sulfate and sodium chloride.

Embodiments of the present invention will be explained in detail in connection with the following examples referring to drawings and comparative examples; however, they do not limit the present invention.

(1) Comparative Test (Comparison of Quaternary Ammonium Salts of the Present Invention and Other Quaternary Ammonium Salts)

In the present invention, antimicrobial properties of various cationic surfactants were compared. Antimicrobial treatment was carried out by dissolving a test compound in warm water, adding an acid or mirabilite, submerging natural bristles for a certain period of time to adsorb the test compound to the natural bristles, then washing and drying the natural bristles. Compounds tested were trimethyl-type ammonium salts such as alkyltrimethylammonium chloride, alkyldimethyl benzyl-type ammonium salts such as myristyldimethylbenzylammonium chloride, dialkyldimethyl-type ammonium salts such as octylhexyldimethylammonium chloride, alkylpyridinium salts such as laurylpyridinium chloride, alkylbenzalconium salts, alkylquinolinium salts, benzetonium chloride, 2-mercaptobenzothiazole salts, pyrithionic acid and salts thereof, pyrithionic acid dimer, alkylparaben, pyrrolnitrin, thiaibendazole, isothiazoline, butyltin maleate.

The natural bristles treated with these compounds mostly showed a halo width of at least 2 mm in the abovementioned halo test.

Next, these natural bristle samples were submerged in the washing solution at 40° C. for 30 minutes, then washed 100 times with rubbing, and subjected to the halo test in the same manner. Results showed that quaternary ammonium salts used in the present invention maintained an excellent halo width while other quaternary ammonium salts showed a large decrease in the halo width and a great change in the hair tips, which resulted in uncomfortableness in use as a cosmetic brush.

(2) Observation of Halo Width

Change in antimicrobial properties of a cosmetic brush of the present invention is observed in the drawings.

Figure 2:
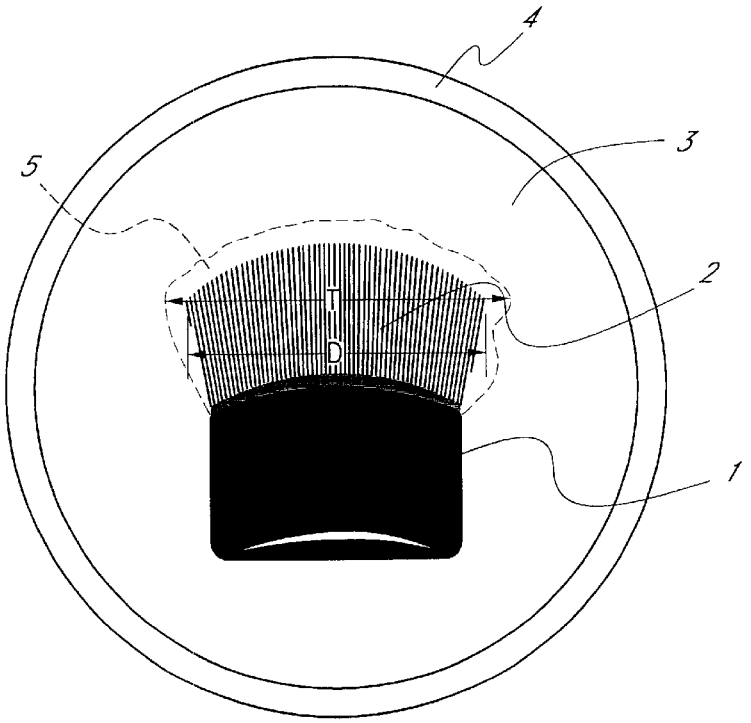
FIG. 2 is a view showing a cosmetic brush after antimicrobial treatment (cation BB, 0.4% (80C, 30 minutes) adsorption) with a cationic surfactant of the present invention.
Figure 3:
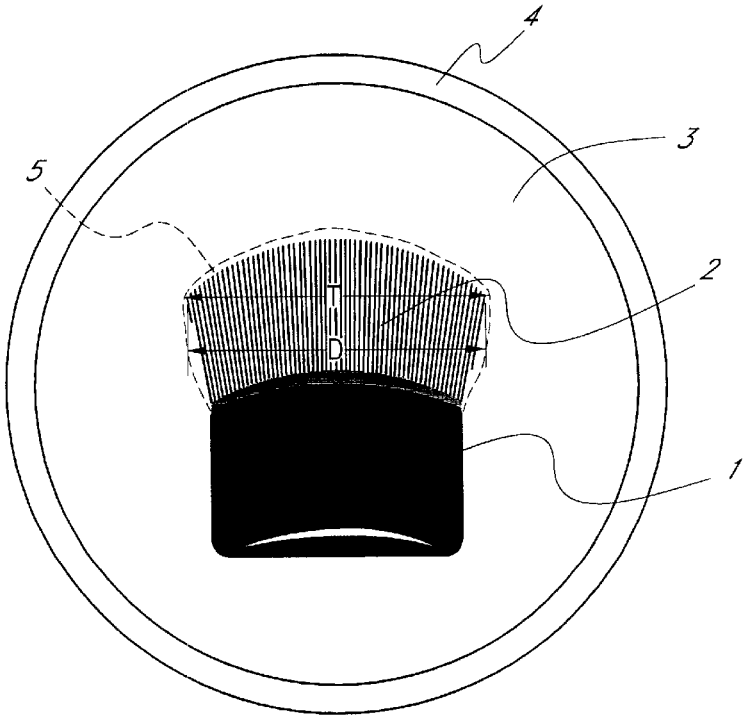
FIG. 3 is a view showing a cosmetic brush of the present invention washed after antimicrobial treatment (0.2% neutral detergent (40C), after washing 100 times with rubbing).

FIG. 1 shows an untreated cosmetic brush as described above. FIG. 2 shows the halo width, in which a cosmetic brush was placed on a medium vessel immediately after the antimicrobial treatment by a cationic surfactant, and FIG. 3 shows the halo width of the cosmetic brush in FIG. 2, which was washed 100 times with rubbing.

The halo width is represented by the equation [W=(T−D)/2] as described above.

The natural bristles obtained according to the present invention showed a halo width of at least 5 mm in the abovementioned halo test. Next, these natural bristles were submerged in an anionic surfactant (alkyl sulfate sodium ester) at 40° C. for 30 minutes, after which the resulting brush was washed 100 times with rubbing. Decrease in the halo width was small. This result revealed that the efficacy was not lost due to binding to the anionic surfactant since the cationic surfactant antimicrobial agent was adsorbed onto the proteins.

EXAMPLE 1

An microbial agent, dodecyltrimethylammonium chloride (1.5% by weight; product name: "Cation BB", a product of Nippon Yushi Co., Ltd.), was dissolved in warm water, 8% by weight mirabilite was added, and horsehairs were submerged in the resulting neutral solution at 80° C. for 30 minutes for adsorption, then washed and dried to obtain horsehairs having antimicrobial properties.

A cosmetic brush made of these natural bristles showed a halo width of at least 7 mm in a halo test using *Staphylococcus aureus.*

Further, these horsehairs were submersed in a soap solution (5 g/L) at 40° C. for 30 minutes, and then washed 100 times with rubbing. The resultant halo width was 6 mm, almost the same as before washing.

EXAMPLE 2

An microbial agent, octadimethylammonium chloride (2.0% by weight; product name: "Cation S-100", a product of Nippon Yushi Co., Ltd.), and 1.5% by weight urea as a protein denaturation agent were dissolved in warm water, and goathairs were submerged in the resulting neutral solution at 80C for 30 minutes for adsorption, then washed and dried to obtain goathairs having antimicrobial properties. A cosmetic brush made of these goathairs showed a halo width of at least 8 mm in a halo test using *Staphylococcus aureus.*

Further, the halo width was 6 mm even after these natural bristles were subjected to the washing treatment as described in Example 1, which showed that the cosmetic brush thus obtained had highly durable antimicrobial properties.

EXAMPLE 3

An microbial agent, yashialkyldimethylammonium chloride (2.0% by weight; product name: "Cation F-100", a product of Nippon Yushi Co., Ltd.), and 5% by weight acetic acid were dissolved in warm water, and horsehairs were submerged in the resulting neutral solution at 80° C. for 30 minutes for adsorption, then washed and dried to obtain horsehairs having antimicrobial properties.

A cosmetic brush made of these horsehairs showed a halo width of at least 9 mm in a halo test using *Staphylococcus aureus.*

Further, the halo width was 7 mm even after these natural bristles were subjected to the washing treatment as described in Example 1, which showed that the cosmetic brush thus obtained had highly durable antimicrobial properties.

EXAMPLE 4

An microbial agent, cetyldimethylbenzylammonium chloride (2.0% by weight; product name: "Sunyzol C", a product of Kao Corporation), and 5% by weight guanidine hydrochloride were dissolved in warm water, and horsehairs were submerged in the resulting neutral solution at 80° C. for 30 minutes for adsorption, then washed and dried to obtain horsehairs having antimicrobial properties.

A cosmetic brush made of these horsehairs showed a halo width of at least 9 mm in a halo test using *Staphylococcus aureus*.

Further, the halo width was 7 mm even after these natural bristles were subjected to the washing treatment as described in Example 1, which showed that the cosmetic brush thus obtained had durable antimicrobial properties.

EXAMPLE 5

An microbial agent, tetradecyldimethylammonium chloride (2.0% by weight; product name: "Nissan Cation M2-100", a product of Nippon Yushi Co., Ltd.), was dissolved in warm water, 8% by weight mirabilite was added, and horsehairs were submerged in the resulting neutral solution at 80° C. for 30 minutes for adsorption, then washed and dried to obtain horsehairs having antimicrobial properties.

A cosmetic brush made of these horsehairs showed a halo width of at least 8 mm in a halo test using *Staphylococcus aureus*.

Further, the halo width was 7 mm even after these natural bristles were subjected to the washing treatment as described in Example 1, which showed that the cosmetic brush thus obtained had highly durable antimicrobial properties.

In Examples 1 through 5, the natural bristles were examined for deodorant and insecticidal properties and feel to the skin and retention of cosmetic agents when used as cosmetic brushes.

In Comparative Examples 1 and 2, horsehairs were submerged in an aqueous 2% by weight solution of a conventional alkylbenzalkonium salt and pyrithionic acid at room temperature for 30 minutes for adsorption.

Evaluation was carried out by 5 female monitors. Results are shown in Table 1. Evaluation: ◎: good, ○: moderately good, Δ: average, ▼: moderately bad, ×: bad.

TABLE 1

| | Deodorant properties | Insecticidal properties | Feel | Cosmetic agent retention |
|---|---|---|---|---|
| Example 1 | ◎ | ◎ | ◎ | ◎ |
| Example 2 | ◎ | ○ | ◎ | ◎ |
| Example 3 | ○ | ◎ | ◎ | ◎ |
| Example 4 | ◎ | ◎ | ◎ | ◎ |
| Example 5 | ◎ | ◎ | ◎ | ◎ |
| Comparative Example 1 | ▼ | ▼ | ▼ | Δ |
| Comparative Example 2 | X | Δ | ○ | Δ |

Discussion on the Results of Examples

The results of the comparative experiments with quaternary ammonium salt antimicrobial agents of the present invention and other quaternary ammonium salts, and the halo tests before and after washing in Examples 1 through 5 revealed that the cosmetic brushes according to the present invention had excellent antimicrobial properties, which was durable and wash-durable, and the comparisons in Comparative Examples 1 and 2 showed that the natural bristles of the cosmetic brushes were excellent in deodorant properties, feel to the skin and cosmetic agent retention.

A hair brush in which natural bristles of the present invention are used is characterized in that it has excellent antimicrobial properties, which is highly durable and wash-durable, hardening of the tip of the natural bristles does not occur when the surface of the bristles are treated with an antimicrobial agent, feel to the skin is gentle, retention of cosmetic agents is exellent, and animal hair odor is extremely well prevented. Furthermore, insecticidal effect is generated so that there is no need to use conventionally used insecticides such as haphthalene. The production cost can be low.

What is claimed is:

1. A cosmetic brush having wash-and-rub-durable antimicrobial and deodorant properties, comprising natural animal hair bristles to which at least one or more kinds of cationic surfactants selected from alkyl ammonium salts containing a quaternary nitrogen or alkylbenzyl ammonium salts containing a quaternary nitrogen, and alkyl pyridinium salts in an amount of 0.2–5% by weight are adhered by heat solution adsorption.

2. The cosmetic brush having wash-and-rub-durable antimicrobial and deodorant properties as claimed in claim 1, wherein proteins of the natural bristles are denatured by a protein denaturation agent.

3. A method of producing a cosmetic brush having wash-and-rub-durable antimicrobial and deodorant properties, characterized in that natural bristles are submerged into an aqueous solution containing at least one or more kinds of cationic surfactants selected from alkyl ammonium salts containing a quaternary nitrogen or alkylbenzyl ammonium salts containing a quaternary nitrogen, and alkyl pyridinium salts, said cationic surfactants in an amount of 0.2–5% by weight are adhered onto the natural bristles by adsorption with heating, and then the resulting natural bristles are used for the cosmetic brush.

4. The method of producing a cosmetic brush as claimed in claim 3, wherein an auxiliary agent for adsorption of the abovementioned cationic surfactants and/or a protein denaturation agent are added to the aqueous solution.

5. The method of producing a cosmetic brush as claimed in claim 3, wherein the protein denaturation agent is urea or guanidine hydrochloride.

6. The method of producing a cosmetic brush as claimed in claim 3, wherein the auxiliary agent for adsorption is an inorganic acid, organic acid or inorganic salt.

7. The method of producing a cosmetic brush as claimed in claim 6, wherein the organic acid is acetic acid, lactic acid, malic acid, or citric acid.

8. The method of producing a cosmetic brush as claimed in claim 6, wherein the inorganic salt is sodium sulfate or sodium chloride.

* * * * *